US009342948B2

(12) United States Patent
Aoki et al.

(10) Patent No.: US 9,342,948 B2
(45) Date of Patent: May 17, 2016

(54) HEAD TRACKING IN COMMUNITY WAGERING GAMES

(71) Applicant: WMS Gaming, Inc., Waukegan, IL (US)

(72) Inventors: Dion K. Aoki, Chicago, IL (US); Sean P. Kelly, Chicago, IL (US); Scott A. Massing, Lincolnwood, IL (US); Pamela S. Smith, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/791,000

(22) Filed: Mar. 8, 2013

(65) Prior Publication Data

US 2014/0073386 A1 Mar. 13, 2014

Related U.S. Application Data

(60) Provisional application No. 61/699,977, filed on Sep. 12, 2012.

(51) Int. Cl.
*A63F 9/24* (2006.01)
*G07F 17/32* (2006.01)

(52) U.S. Cl.
CPC ..... *G07F 17/3204* (2013.01); *G07F 17/3206* (2013.01); *G07F 17/3209* (2013.01); *G07F 17/3293* (2013.01)

(58) Field of Classification Search
CPC ..... G07F 17/32; G07F 17/3209
USPC ..... 463/13, 31, 32, 42, 36
See application file for complete search history.

(56) References Cited

U.S. PATENT DOCUMENTS

| | | | | |
|---|---|---|---|---|
| 6,822,643 | B2 * | 11/2004 | Matsui et al. | 345/204 |
| 7,654,899 | B2 | 2/2010 | Durham et al. | |
| 7,841,944 | B2 | 11/2010 | Wells | |
| 7,883,415 | B2 * | 2/2011 | Larsen et al. | 463/36 |
| 8,165,347 | B2 * | 4/2012 | Heinzmann et al. | 382/103 |
| 8,540,569 | B2 * | 9/2013 | Orlinsky et al. | 463/30 |
| 8,696,458 | B2 * | 4/2014 | Foxlin | G07F 17/32 345/156 |
| 2001/0040572 | A1 * | 11/2001 | Bradski et al. | 345/419 |
| 2002/0037770 | A1 * | 3/2002 | Paul et al. | 463/36 |
| 2005/0040601 | A1 * | 2/2005 | Yoseloff et al. | 273/292 |
| 2005/0282605 | A1 * | 12/2005 | Englman et al. | 463/13 |
| 2006/0009283 | A1 * | 1/2006 | Englman et al. | 463/29 |
| 2006/0258425 | A1 * | 11/2006 | Edidin et al. | 463/16 |
| 2007/0060390 | A1 * | 3/2007 | Wells | 463/46 |
| 2009/0233769 | A1 * | 9/2009 | Pryor | 482/8 |
| 2010/0041464 | A1 * | 2/2010 | Arezina et al. | 463/22 |

FOREIGN PATENT DOCUMENTS

WO WO 2011063197 A1 * 5/2011

* cited by examiner

*Primary Examiner* — Jay Liddle
*Assistant Examiner* — Ryan Hsu
(74) *Attorney, Agent, or Firm* — DeLizio Law, PLLC

(57) ABSTRACT

Some embodiments include a method for conducting a multi-player wagering game. The method can include determining, by at least on processor, a head position of a player of the multi-player wagering game. The method can also include determining, based on the head position, a viewable portion of a virtual object used in the multi-player wagering game, and causing presentation of the viewable portion of the virtual object.

22 Claims, 11 Drawing Sheets

HEAD TRACKING IN COMMUNITY WAGERING GAMES

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to wagering game systems including multiplayer games that utilize head tracking technologies.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Introduction

This section provides an introduction to some embodiments of the invention.

Some embodiments of the inventive subject matter conduct multiplayer games, where the multiplayer games are presented on multiple wagering game machines. In such multiplayer games, a virtual object (e.g., a globe, space ship, etc.) is presented to each player. Each player may have a different view of the virtual object, depending on factors such as where the player's wagering game machine resides on a casino floor. For example, the virtual object may be a globe (i.e., a spherical rendition of Earth). On a wagering game machine on the casino's south side, a player may see a view of the globe that includes Australia. On a machine on the casino's north side, a player may see North America on the globe.

Some embodiments use head tracking technology to change a player's view of the virtual object based on the player's viewing perspective. This effect simulates looking through a window, where head movements reveal different fields of view. For example, if a player changes viewing perspectives (e.g., leans leftward and peers rightward at a display device), the player may see a portion of the globe that was not visible from the player's original viewing perspective.

In some embodiments, one or more virtual objects are game elements in the multiplayer game. For example, the virtual objects can be playing cards in a video Texas Hold 'Em poker game. Alternatively, the virtual objects can be shared picking elements, shared slots reel symbols, or any other suitable game elements. The players can interact with the virtual objects to affect game results.

Figure 1A:
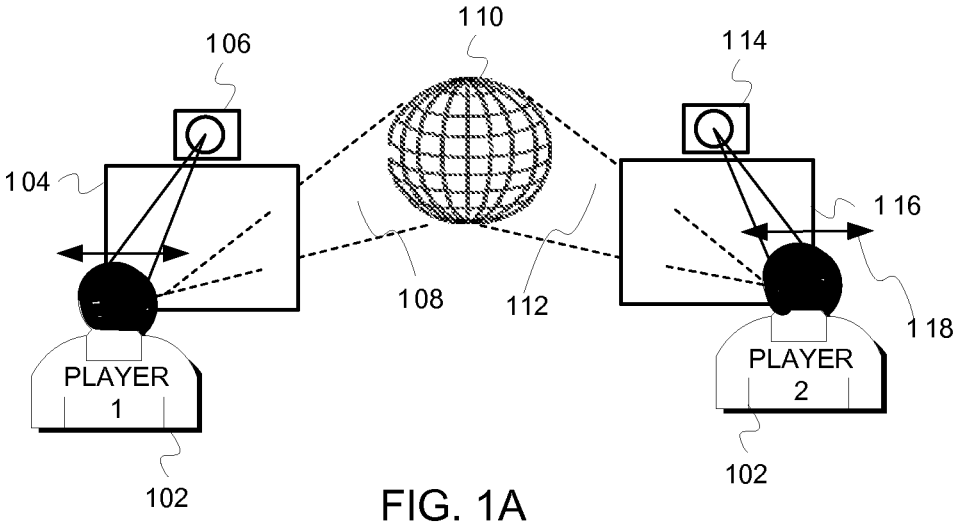
FIG. 1A is a conceptual diagram showing two players 102 each viewing a virtual object on a separate wagering game machine.
Figure 1B:
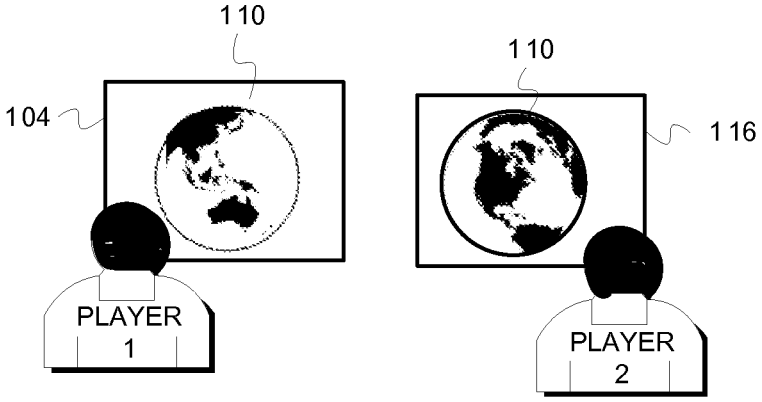
FIG. 1B shows each player's view of the virtual object.

FIGS. 1A and 1B illustrate the concepts discussed above. FIG. 1A is a conceptual diagram showing two players 102 each viewing a virtual object on a separate wagering game machine. In FIG. 1A, player-1 sits in front of a wagering game machine display 104 and head tracking camera 106. The head tracking camera 106 can track player 1's head movements and body positions. Player-2 sits in front of a wagering game machine display 116 and camera 114. The head tracking camera 106 can track player 2's head movements and body positions. FIG. 1A shows only display devices and cameras, omitting all other components of the wagering game machines.

As shown, player-1 can see the virtual object 110 (i.e. globe 110) though a viewing field 108. Player-2 can see the globe 110 through a viewing field 112. Because the viewing fields are different for each player, each player sees a different part of the virtual object 110. FIG. 1B shows each player's view of the virtual object. In FIG. 1B, player-1 sees Australia on the globe 110, whereas player-2 sees North America on the globe 110.

Referring back to FIG. 1A, the head tracking cameras 106 and 114 can detect when the players 102 change their viewing perspective. The players 102 may change their viewing perspective by moving closer to or away from the displays 104 & 116, leaning leftward/rightward/forward/backward, head tilting, etc. As a player's viewing perspective changes, the player can see different aspects of the virtual object. In some instances, leaning leftward/rightward changes a player's viewing perspective enough to reveal yet unseen portions of the virtual object. For example, in FIG. 1B, if player-2 moves rightward and forward (toward the display 116), the system will detect such movements and reveal more of Europe on the globe 110.

Operating Environment

This section describes an example operating environment and presents structural aspects of some embodiments. This section includes discussion about wagering game machine architectures and wagering game networks.

Figure 2:
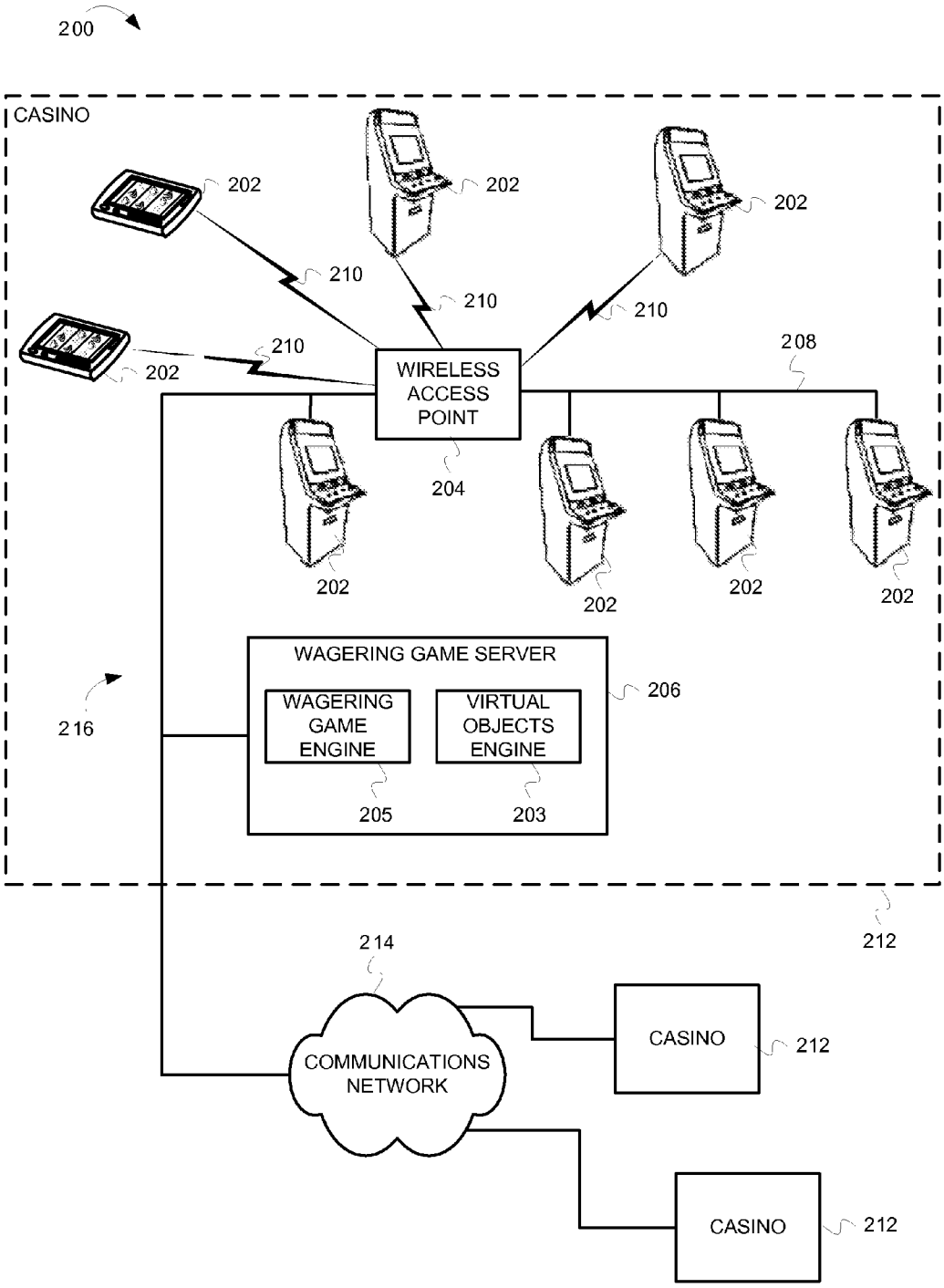
FIG. 2 is a block diagram illustrating a wagering game network, according to example embodiments of the invention.

FIG. 2 is a block diagram illustrating a wagering game network 200, according to example embodiments of the invention. As shown in FIG. 2, the wagering game network 200 includes a plurality of casinos 212 connected to a communications network 214.

Each casino 212 includes a local area network 216, which includes an access point 204, a wagering game server 206, and wagering game machines 202. The access point 204 provides wireless communication links 210 and wired communication links 208. The wired and wireless communication links can employ any suitable connection technology, such as Bluetooth, 802.11, Ethernet, public switched telephone networks, SONET, etc. In some embodiments, the wagering game server 206 can serve wagering games and distribute content to devices located in other casinos 212 or at other locations on the communications network 214.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc.

The wagering game machines 202 can include head tracking cameras (not show in FIG. 2) that detect players' head movements. In some embodiments, the machines 202 transmit head tracking data to the wagering game server 206 for processing. In other embodiments, the wagering game machines themselves process head tracking data. Some embodiments use the head tracking data to change player viewing fields with respect to virtual objects presented in group wagering games. The discussion of FIG. 4 (below) provides additional details about head tracking cameras.

As noted above, the wagering game machines 202 can present wagering games that include virtual objects viewable by players at a plurality of the machines 202. The discussion of FIGS. 5-10 describe how various embodiments present virtual objects to a plurality of players at a plurality of wagering game machines.

The wagering game server 206 includes a wagering game engine 205 and a virtual objects engine 203. The wagering game engine 205 can determine results for wagering games presented on the machines 202. In some instances, the wagering game engine 205 also determines and streams content (e.g., graphics, audio, etc.) for wagering games presented on the machines 202. The virtual objects engine 203 can create and process data representing virtual objects. In some instances, the virtual objects engine 203 creates graphical content for transmission to the machines 202. In other instances, the virtual objects engine 203 transmits, to the machines 202, data representing virtual objects. In turn, the machines 202 can process the data to graphically render virtual objects.

In some embodiments, wagering game machines 202 and wagering game servers 206 work together such that a wagering game machine 202 can be operated as a thin, thick, or intermediate client. For example, one or more elements of game play may be controlled by the wagering game machine 202 (client) or the wagering game server 206 (server). Game play elements can include executable game code, lookup tables, configuration files, game outcome, audio or visual representations of the game, game assets or the like. In a thin-client example, the wagering game server 206 can perform functions such as determining game outcome or managing assets, while the wagering game machine 202 can present a graphical representation of such outcome or asset modification to the user (e.g., player). In a thick-client example, the wagering game machines 202 can determine game outcomes and communicate the outcomes to the wagering game server 206 for recording or managing a player's account.

In some embodiments, either the wagering game machines 202 (client) or the wagering game server 206 can provide functionality that is not directly related to game play. For example, account transactions and account rules may be managed centrally (e.g., by the wagering game server 206) or locally (e.g., by the wagering game machine 202). Other functionality not directly related to game play may include power management, presentation of advertising, software or firmware updates, system quality or security checks, etc.

In some embodiments, the wagering game network 200 can include other network devices, such as accounting servers, wide area progressive servers, player tracking servers, and/or other devices suitable for use in connection with embodiments of the invention.

Any of the wagering game network components (e.g., the wagering game machines 202) can include hardware and computer readable media including instructions for performing the operations described herein. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Wagering Game Machine Architectures

Figure 3:
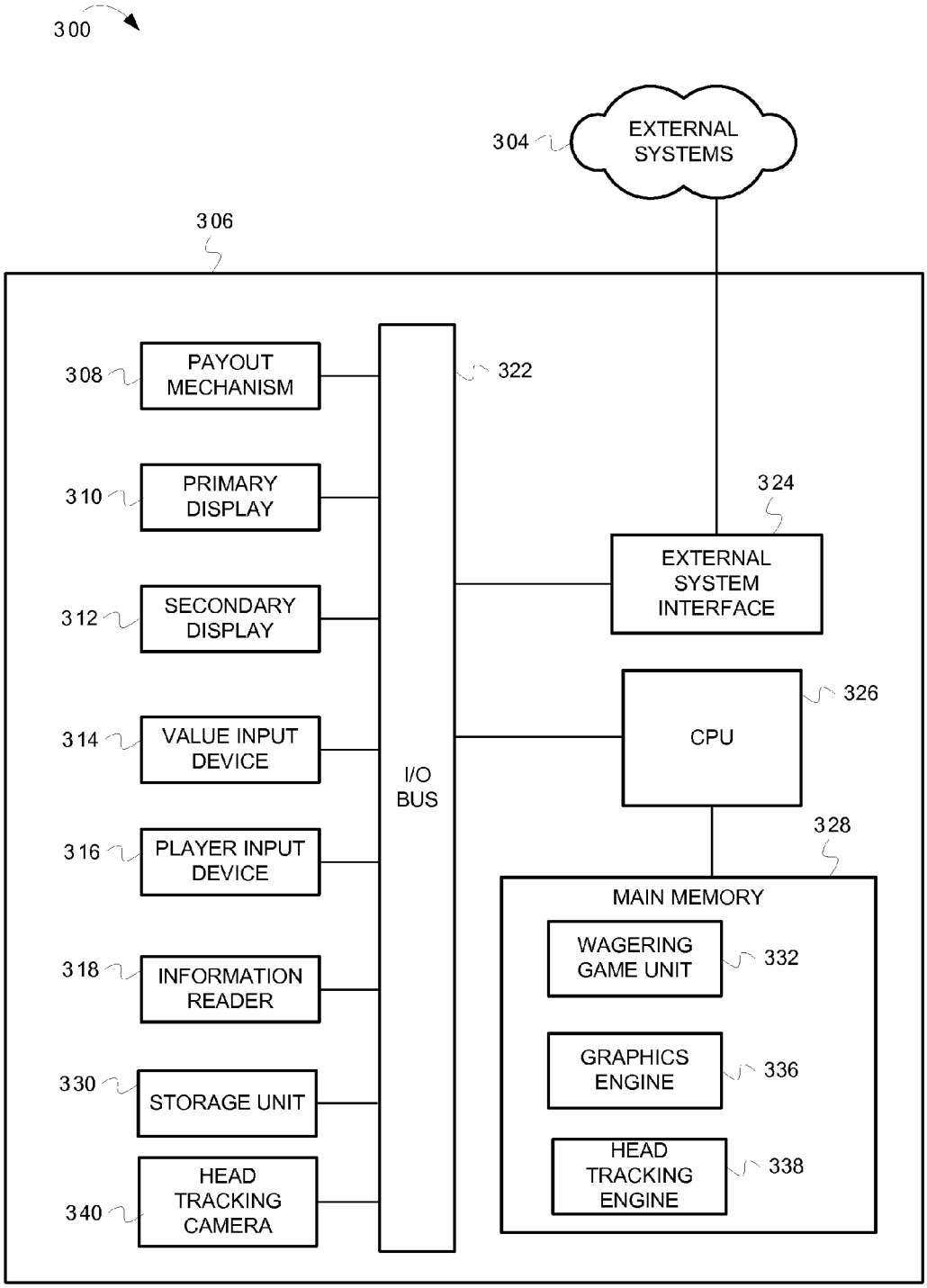
FIG. 3 is a block diagram illustrating a wagering game machine architecture, according to example embodiments of the invention.

FIG. 3 is a block diagram illustrating a wagering game machine architecture, according to example embodiments of the invention. As shown in FIG. 3, the wagering game machine architecture 300 includes a wagering game machine 306, which includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor.

The main memory 328 includes a wagering game unit 332, graphics engine 336, and head tracking unit 338. In one embodiment, the wagering game unit 332 can present wagering games, such as video poker, video black jack, video slots, video lottery, etc., in whole or part. The graphics engine 336 can process data representing virtual objects, and present the virtual objects on a primary display 310. The head tracking engine 338 can operate in concert with the head tracking camera 340 to track player head movements. In some embodiments, the head tracking engine 338 transmits head tracking data to a remote wagering game server. In other embodiments, the head tracking engine 338 processes head tracking data to determine whether to modify a player's viewing field with respect to a virtual object. Operations and functionality of the graphics engine 336 and head tracking unit 338 are described in greater detail in the following sections.

The CPU 326 is also connected to an input/output (I/O) bus 322, which can include any suitable bus technologies, such as an AGTL+ frontside bus and a PCI backside bus. The I/O bus 322 is connected to a payout mechanism 308, primary display 310, secondary display 312, value input device 314, player input device 316, information reader 318, and storage unit 330. The player input device 316 can include the value input device 314 to the extent the player input device 316 is used to place wagers. The I/O bus 322 is also connected to an external system interface 324, which is connected to external systems 304 (e.g., wagering game networks).

In one embodiment, the wagering game machine 306 can include additional peripheral devices and/or more than one of each component shown in FIG. 3. For example, in one embodiment, the wagering game machine 306 can include multiple external system interfaces 324 and/or multiple CPUs 326. In one embodiment, any of the components can be integrated or subdivided.

Any component of the architecture 300 can include one or more of hardware, firmware, and machine-readable storage media including instructions for performing the operations described herein.

Head Tracking and Virtual objects

Figure 4:
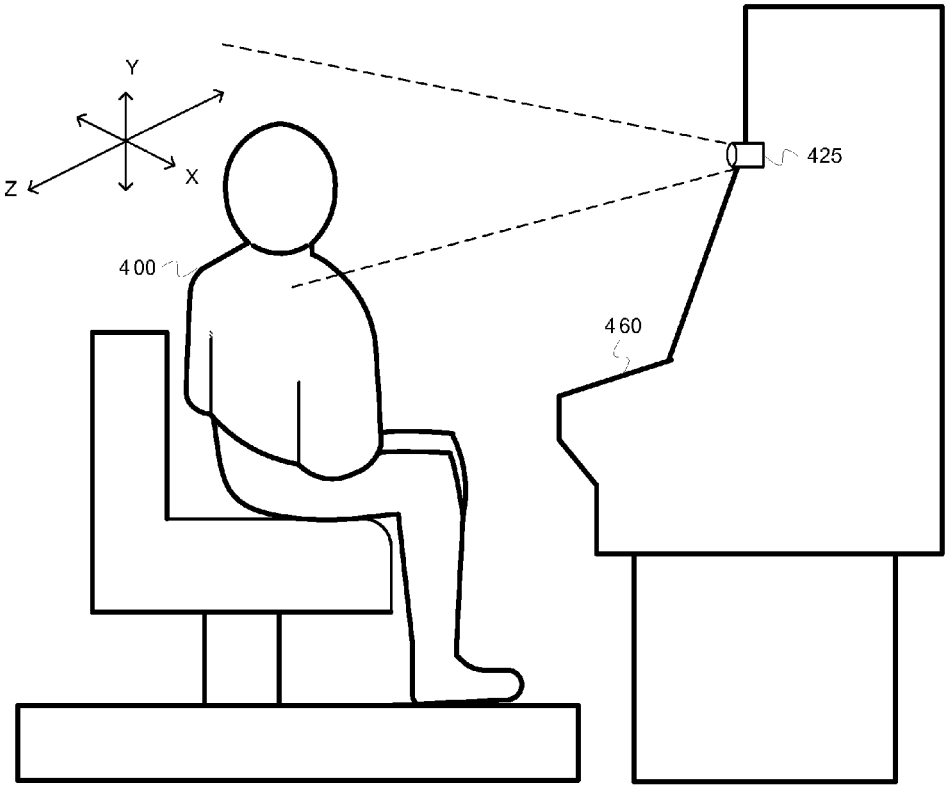
FIG. 4 is a conceptual diagram illustrating a wagering game machine capable of tracking a player's head movements.

This discussion continues with move details about head tracking technologies employed by some embodiments of the inventive subject matter. FIG. 4 is a conceptual diagram illustrating a wagering game machine capable of tracking a player's head movements. In FIG. 4, a wagering game machine 425 includes a head tracking camera 425. The head tracking camera 425 can detect head movements, facial gestures, and facial features of a player 400. In some embodiments, head tracking camera facilitates facial recognition to identify the player 400. After detecting head movements, the wagering game machine 460 can modify display content to appear from the player's new viewing perspective. For example, the wagering game machine 460 can modify orientation game content (e.g., game elements such as slot reels) to provide the player a different point of view.

In some implementations, the video capture device 425 can capture video of the player's head movements, facial gestures, and facial features. The wagering game machine 460 can then generate player input data (e.g., a plurality of variables) that represents the x, y, and z coordinates of the player's head at various instances in time. This data can be used to determine the player's head movements. The wagering game machine 460 can also generate player input data that represents the x, y, and z coordinates of various data points of the player's facial features. This data can be used to determine the player's facial movements (e.g., where the player 400 is looking, the player's facial gestures, etc.). In one example, the wagering game machine 460 may generate data representing x, y, and z coordinates for multiple data points in a player's eyes, nose, mouth, forehead, chin, etc. The wagering game machine 460 can process data associated with the head movements and facial gestures to determine the player's viewing perspective. In some embodiments, the wagering game machine 460 can compare the x, y, and z coordinates of the player's head at various instances in time to one or more reference points (e.g., (x,y,z)=(0,0,0)) to quantify the player's head movement with respect to the reference points. In turn, the wagering game machine 460 can modify display content (e.g., a view of a virtual object) to be consistent with the player's viewing perfective.

Figure 5A:
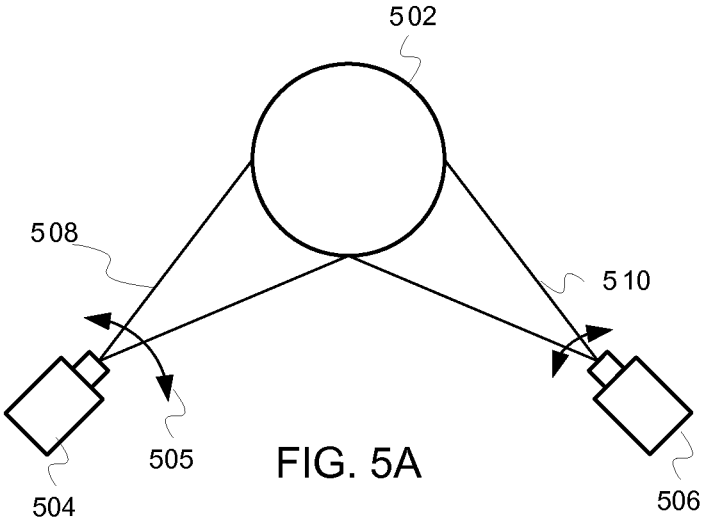
FIGS. 5A & 5B show a plurality of viewing perspectives for virtual objects used in community wagering games.
Figure 5B:
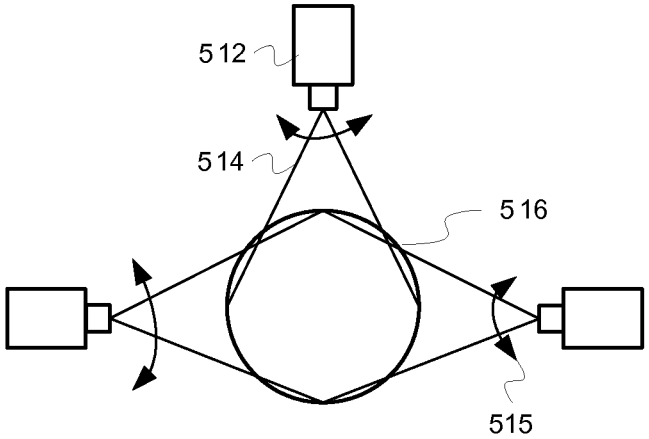

This discussion will continue with an explanation of how some embodiments process virtual objects. FIGS. 5A & 5B show a plurality of viewing perspectives for virtual objects used in community wagering games. The discussion of FIGS. 5A & 5B will explain how some embodiments generate virtual objects, and how they create different viewing perspectives for different players. The virtual object 502 can include any geometric shape, such as a cube, rectangle, sphere, composition of polygons, etc. The geometric shape defines a size and shape of the object 502. In FIG. 5A (like FIG. 1A), the object's geometric shape is a sphere. In addition to shape, the object 502 can have one or more textures mapped onto the geometric shape's surface to define an appearance of an object. Textures can include graphics, photos, etc. In FIG. 1B, the texture is a photograph of the Earth, which is mapped onto a sphere to form the globe 110 (i.e., the virtual object).

After creating one or more virtual objects, the virtual objects engine 203 (see FIG. 2) can determine how each player will view the object(s). The virtual objects engine 203 can use virtual cameras to determine what portion of an object 502 each player sees. In FIG. 5A, there are two viewing perspectives for the object 502. A first player will see the virtual object 502 through a viewing field 508, while a second player will see the object 502 through a viewing field 506. One viewing perspective is taken from a first virtual camera 504, while another viewing perspective is taken from a second virtual camera 506. The virtual cameras 504 and 506 can be positioned and oriented anywhere with respect to the object 502. The virtual cameras behave like real-world cameras, as they may have focal length, depth of field, shutter speed, resolution, aperture size, etc. The virtual objects unit 203 can pan, zoom, reposition, and otherwise change the virtual cameras' viewing fields (see arrow 505). The virtual objects engine 203 may change the viewing fields 508 and 510 based on players' head movements and other factors (e.g., game results, etc.).

The virtual objects engine 203 can determine initial positions and settings for the virtual camera (i.e., initial viewing fields) based on information including gaming machine position in a casino, gaming machine position in a bank, number of players in community game, player status (e.g., high roller, etc.), and any other suitable information. After initially positioning and configuring each virtual camera, the engine 203 enables each player to see virtual images captured by their virtual camera (i.e., images captured in the viewing fields 508 and 510).

FIG. 5A shows how some embodiments may employ two virtual cameras, whereas FIG. 5B shows has some embodiments may use three virtual cameras. These embodiments can use any suitable number of virtual cameras to enable players to view a virtual object. In some instances, the number of players in a community game determines the number of virtual cameras. In other instances, the number of players requesting to see a virtual object(s) determines the number of virtual cameras.

Figure 6:
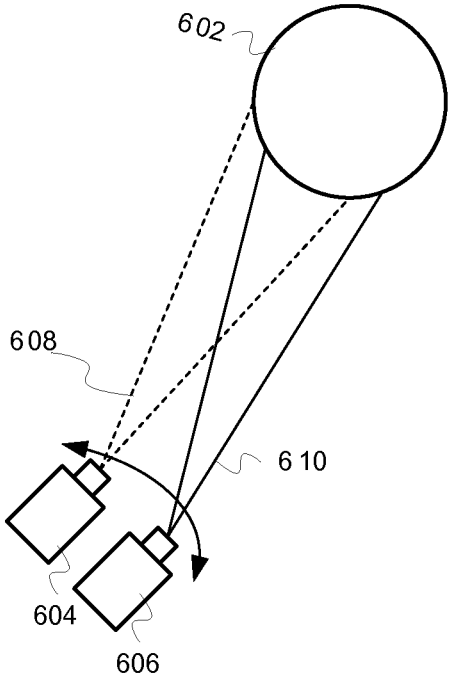
FIG. 6 illustrates how some embodiments utilize two virtual cameras to facilitate viewing on 3D autostereoscopic display devices.

Some embodiments of the inventive subject matter work with three-dimensional (3D) autostereoscopic display devices. FIG. 6 illustrates how some embodiments utilize two virtual cameras to facilitate viewing on 3D autostereoscopic or 3D stereoscopic display devices. In FIG. 6, two virtual cameras 604 & 606 are directed at a virtual object 602. When supporting autostereoscopic 3D displays, one virtual camera 606 captures images that will be presented to a player's right eye (e.g., see viewing field 610), while a second virtual camera 604 captures images for the player's left eye (e.g., see viewing field 608). An autostereoscopic 3D display can receive the two image streams and present them with an appearance of true 3D (i.e., as if the images are in space outside the display device). As similarly discussed above, the virtual cameras 604 and 606 can move in response to various factors, such as head tracking information, game results, etc. Although FIG. 6 shows virtual cameras that facilitate 3D viewing for a single player, embodiments support such viewing for a plurality of players. For example, the virtual objects engine 203 can employ multiple virtual camera pairs to facilitate a community wagering game where each player can view the virtual object 602 on an autostereoscopic 3D display device. The above-described techniques also work for embodiments that employ stereoscopic display devices.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media, while in other embodiments, the operations can be performed by hardware and/or other components (e.g., firmware). In some embodiments, the operations can be performed in series, while in other embodiments, one or more of the operations can be performed in parallel. Moreover, some embodiments can perform less than all the operations shown in any flow diagram.

Figure 7:
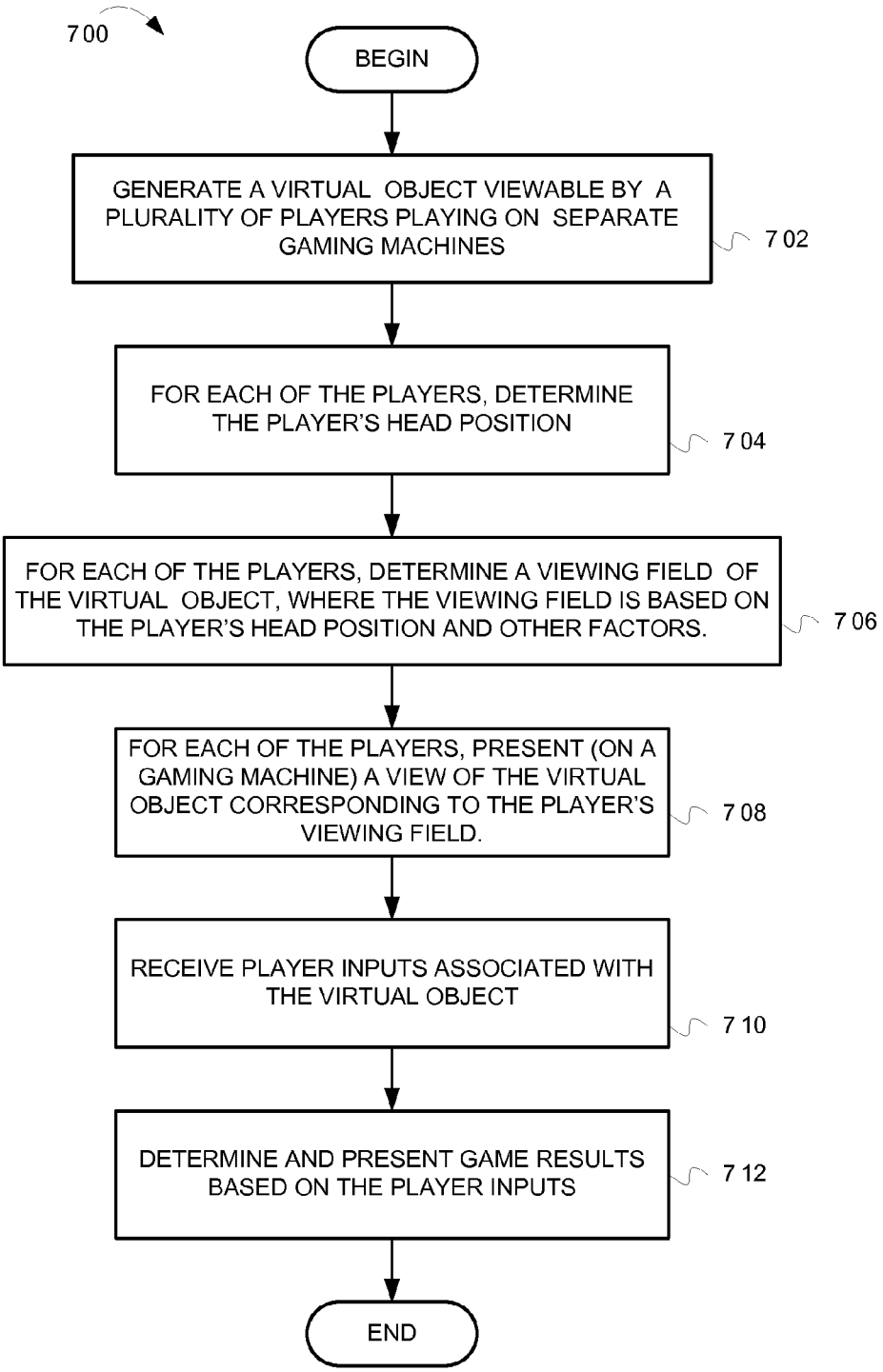
FIG. 7 is a flow diagram illustrating operations for enabling a plurality of players to view a virtual object as part of a wagering game, according to some embodiments of the inventive subject matter.

FIG. 7 is a flow diagram illustrating operations for enabling a plurality of players to view a virtual object as part of a wagering game, according to some embodiments of the inventive subject matter. In some embodiments, a flow 700 is performed by a wagering game server (e.g., see FIG. 2). In FIG. 7, a flow 700 begins at block 702, where the wagering game server's virtual object engine generates a virtual object for a plurality of players playing on separate wagering game machines. As noted above, the engine 203 can generate the virtual object by generating a geometric shape, and mapping a texture to the shape. In some embodiments, the virtual object can be a game element used in a community game, such as a picking bonus game. From block 702, the flow continues at block 704.

At block 704, the virtual object engine determines a head position for each of the plurality of players. In some embodiments, the virtual object engine receives head tracking information from wagering game machines equipped with head tracking equipment. The flow continues at block 706.

At block 706, the virtual objects engine determines a viewing field of the virtual object for each of the players. Each viewing field may be based on a player's head position, and other factors (e.g., wagering game machine position in a casino, players role in a game, number of players, etc.). In some embodiments, the virtual objects engine employs virtual cameras to capture images (e.g., portions of the virtual object) in the viewing fields. For embodiments using autostereoscopic 3D displays, the virtual objects engine can employ two virtual cameras for each player, as described above. The flow continues at block 708.

At block 708, the virtual objects engine presents to each player a view of the virtual object, where the view corresponds to each player's viewing field (e.g., see FIG. 1B). In some embodiments, the virtual object engine transmits viewing information to the wagering game machines. The wagering game machines use the viewing information along with locally stored content to present views of the virtual object. The flow continues at block 710.

At block 710, the wagering game server's wagering game engine receives player inputs associated with the virtual object. For example, the virtual object may be associated with game elements, such as items to be selected in a community picking bonus game. Each player may see and select different items (see discussion of FIGS. 8 and 9 below). As another example, a plurality of virtual objects may represent cards in a community video card game, such as Texas Hold 'Em. The wagering game server can receives card selections etc. The flow continues at block 712.

At block 712, the wagering game engine determines and presents game results based on the player inputs. In some embodiments, the wagering game engine transmits game results to wagering game machines, which in turn present the results using locally stored content. Alternatively, wagering game engine can transmit game results and content for presentation on the wagering game machines.

Using Virtual Objects and Head Tracking in Community Games

This section provides examples showing how some embodiments utilize virtual objects and head tracking in community wagering games.

Figure 8A:
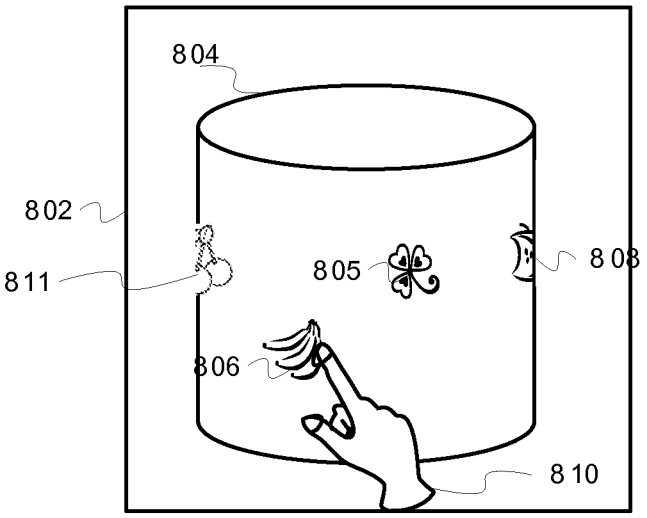
FIGS. 8A and 8B illustrate how different players may see different portions of a virtual object in a community picking game.
Figure 8B:
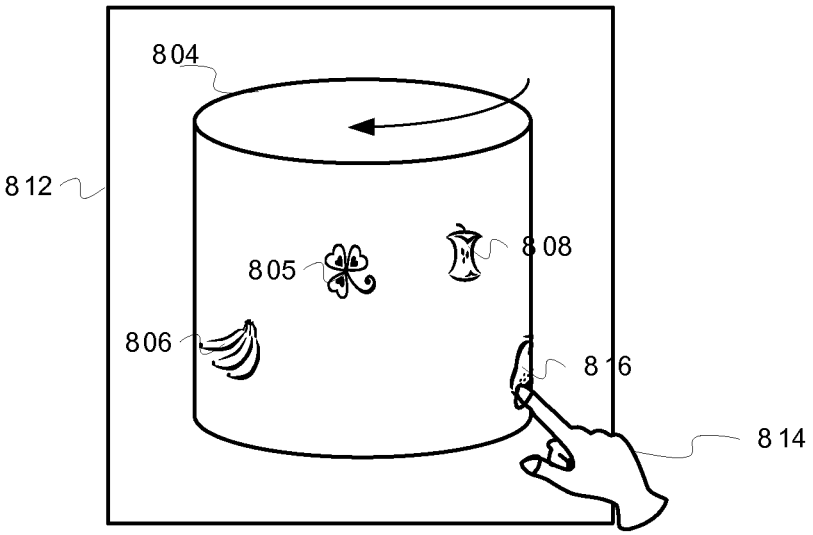

FIGS. 8A and 8B illustrate how different players may see different portions of a virtual object in a community picking game. FIG. 8A shows a first player's view of a virtual object 804. In FIG. 8A, a player 810 sees a cylinder including the following selection items for a community picking game: cherry 811, bananas 806, shamrock 805, and apple core 808. FIG. 8B shows a second player's view of the virtual object 804. In FIG. 8B, the second player's view shows the banana 806, shamrock 805, and apple core 808. The second player's view also shows a strawberry 816, which is not visible in FIG. 8A. However, the second player's view does not show the cherry 811.

Because embodiments are equipped with head tracking technologies, the player's 810 and 814 can modify their viewing fields with head movements. For example, in FIG. 8A, the player 810 can lean rightward to modify the view shown on the display device 802. In response to a rightward lean, the system can modify the view to reveal part of the strawberry 816, as if the player is peaking further around the cylinder. Likewise, the player 814 (in FIG. 8B) can lean leftward to reveal the cherry 811. After exploring the different viewing perspectives, the players can select one of the selection elements as part of the community picking game. Therefore, embodiments enable a plurality of players to view a common virtual object from different perspectives, and to modify those perspectives based on head movements.

Figure 9A:
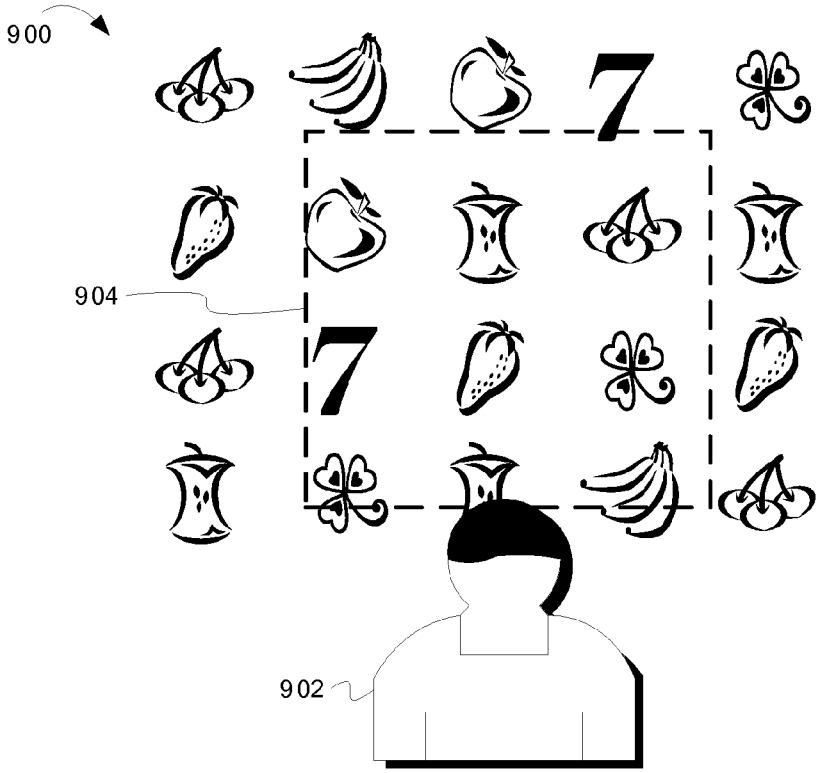
FIGS. 9A and 9B show how some embodiments use head tracking to reveal different portions of a virtual object.
Figure 9B:
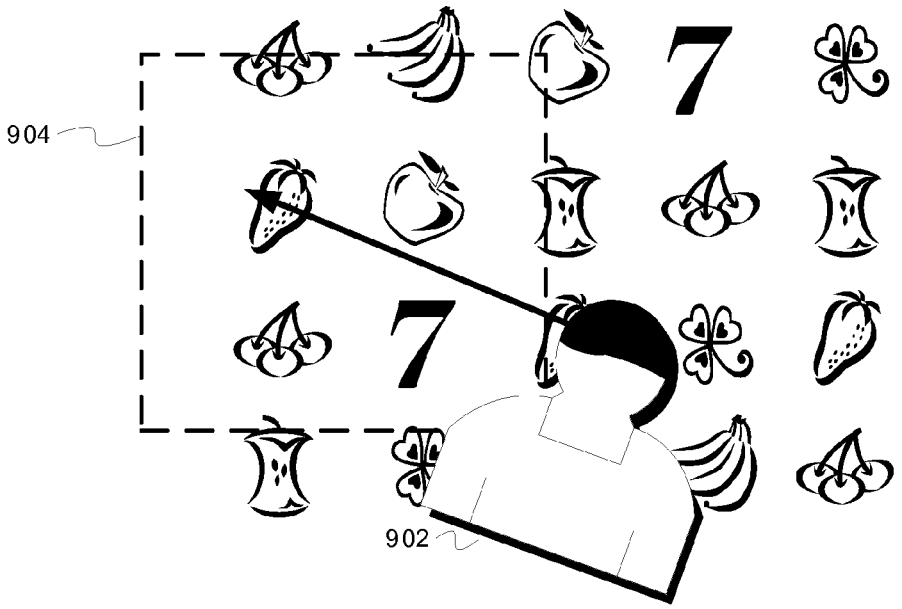

FIGS. 9A and 9B show how some embodiments use head tracking to reveal different portions of a virtual object. In FIG. 9A, a virtual object includes a field of selection elements 900 for a community picking game. The player 902 cannot see the entire picking field 900. Instead, the player's viewing field is limited to the selection elements within the dotted line 904. That is, a display device shows the selection elements inside the dotted line 904. FIG. 9B shows how the player 902 can lean to change the viewing field. Utilizing head tracking functionality, embodiments can modify the player's viewing field to reveal different selection elements included in the virtual object. As a result, some embodiments enable players to access different shared game elements based on head movements.

Figure 10:
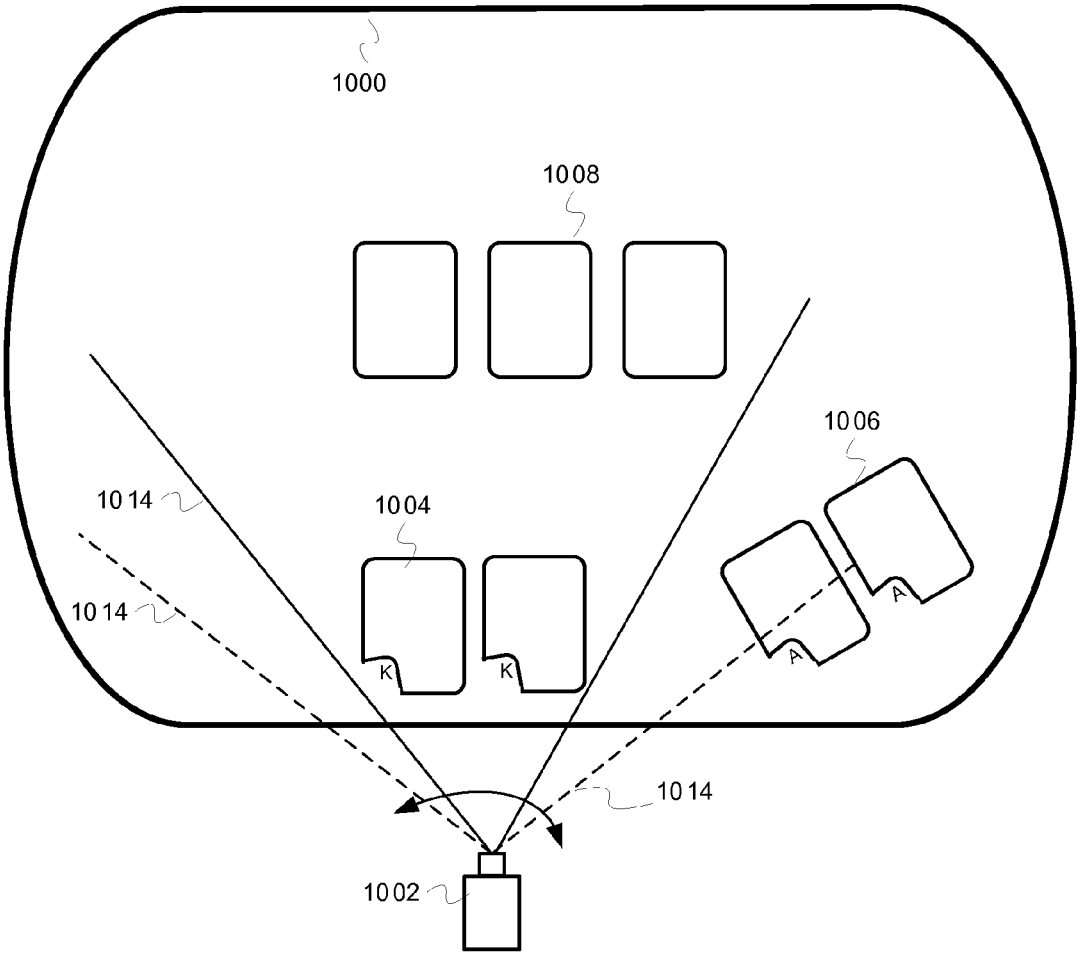
FIG. 10 is a conceptual diagram showing a community wagering game in which players can view and interact with shared virtual objects

FIG. 10 is a conceptual diagram showing a community wagering game in which players can view and interact with shared virtual objects. FIG. 10 shows a plurality of virtual objects including a virtual table 1000, and virtual playing cards 1006, 1006, and 1008. The playing cards are elements in a Texas Hold 'Em card game. The cards 1004 and 1006 appear facedown with corners bent upward to reveal the cards' ranks and suits. The cards 1004 belong to a first player, whereas the cards 1006 belong to a second player. The cards 1008 are community cards shared by the first and second players, according to the rules of Texas Hold 'Em. The virtual camera 1002 determines the first player's viewing field. Initially, the virtual camera 1002 captures a viewing field defined by solid lines 1014. Thus, the first player can initially see his own cards 1004 and the shared cards 1008. Based on the first player's head movements, the first player can modify the viewing field to see other virtual objects. By leaning backward (e.g., away from the display device), the first player's viewing field may widen, as shown by dotted lines 1014. Although head movements widen the first player's viewing field, some embodiments limit the viewing field such that the first player cannot see the second player's cards 1006. Therefore, a factor influencing a player's viewing field may be whether certain shared objects are associated with other players. For beginner card players, embodiments may limit viewing fields to preclude players from seeing each other's cards. However, for advanced card players, viewing fields may be unrestricted. Embodiments that work with autostereoscopic 3D displays would utilize another virtual camera to capture left eye and right eye images.

Embodiments of the inventive subject matter are not limited to the gaming concepts described above. The following is a non-exhaustive list of how various embodiments can utilize head-tracking capabilities and virtual objects to enhance community games.

Fish Bowl Bonus—A fishbowl community bonus game can include numerous virtual objects, such as virtual fish and marine life. Activities of the fish and marine life may represent game results. For example, a fish may eat fish food, representing a bonus payout for one of the community players. The fishbowl bonus may appear on a wagering game machine's display device. A player can move his/her head to view different fish and marine life, much like real-life viewing of fish and marine life through a boat's under water porthole. As the player's head moves, the system reveals different virtual objects.

Picking Game Peaking—In a picking game that requires players to select items from a selection grid, a player can move his/her head to see more detail about the items in the selection grid. If the items are cubes, a player may crane his/her head to see different sides of the cubes. As the player's head moves, the system reveals different sides of the cubes. Certain cube sides may have hints about whether the item will result in a winning pick. Alternatively, the hint may indicate a prize that will be won if the item is a winning pick.

Virtual Coalition Games—In virtual coalition games, players at two different casinos are looking at the same virtual objects. However, the players of each casino may have different views. The players in a first casino may see selection items needed by players in a second casino. Working together, the players may help each other make selections that result in larger awards. Such games motivate communication between players.

Driving/Flight Control—Some community games simulate driving, flying, or controlling other vehicles. As players drive/fly they may move their heads to reveal virtual objects not seen from their current vantage point.

Freeze/Unfreeze—A freeze/unfreeze feature enables players to press a button (or provide other user input) to freeze a virtual object's movement. After the virtual object stops moving, a player can peek at different sides of the object by moving his/her head. Peeking may enable the player to glean information about the wagering game.

Skill-based Collaboration—A skill-based collaboration requires two or more players to work together to accomplish a task involving a virtual object. For example, two players can work together to balance a delicate egg (the virtual object) on sticks. Any one player alone cannot move the egg without cracking it. However, working together two or more players can carry the egg to a goal. Each player can view the egg from their own viewing perspective.

Wagering Game Machines

Figure 11:
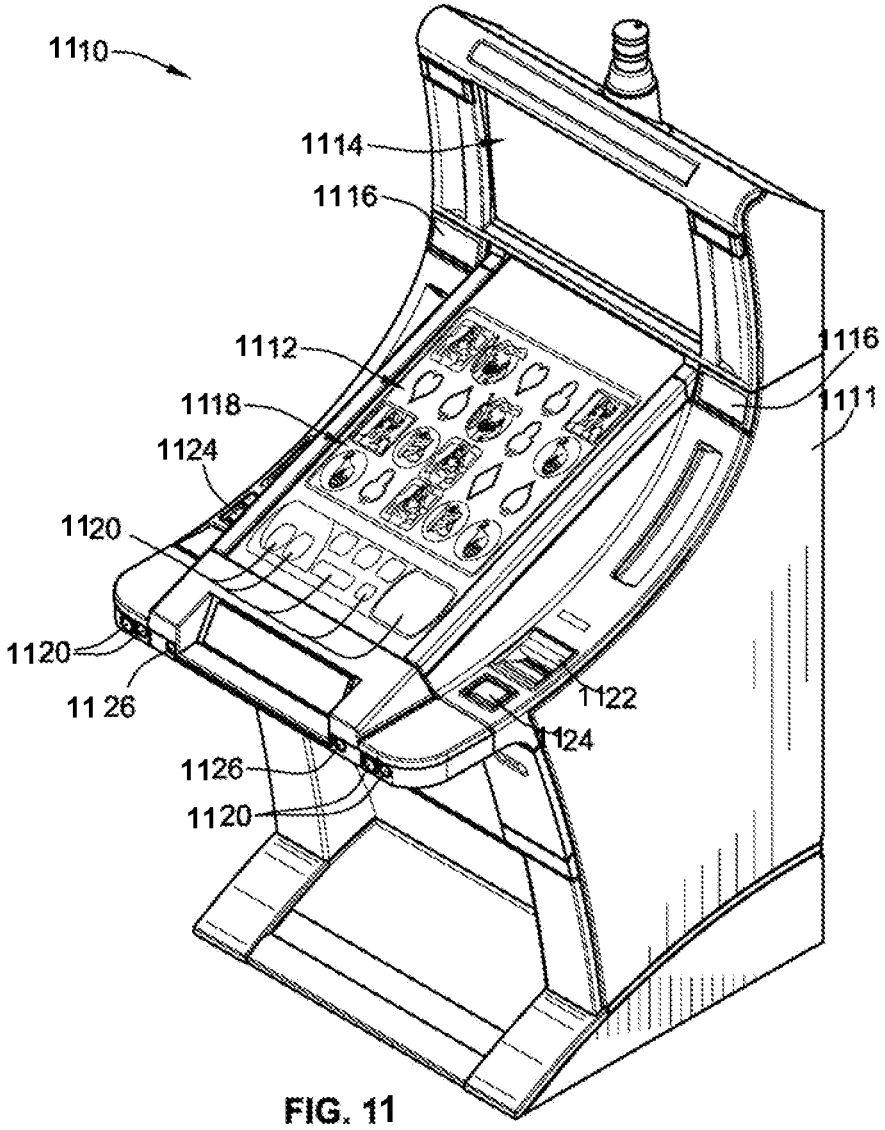
FIG. 11 shows a wagering game machine.

Referring to FIG. 11, there is shown a wagering game machine 1110 similar to those used in gaming establishments, such as casinos. With regard to the present invention, the wagering game machine 1110 may be any type of wagering game machine and may have varying structures and methods of operation. For example, in some aspects, the wagering game machine 1110 is an electromechanical wagering game machine configured to play mechanical slots, whereas in other aspects, the wagering game machine is an electronic wagering game machine configured to play a video casino game, such as slots, keno, poker, blackjack, roulette, craps, etc. The wagering game machine 1110 may take any suitable form, such as floor-standing models as shown, handheld mobile units, bartop models, workstation-type console models, etc. Further, the wagering game machine 1110 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 1110 illustrated in FIG. 11 comprises a cabinet 1111 that may house various input devices, output devices, and input/output devices. By way of example, the wagering game machine 1110 includes a primary display area 1112, a secondary display area 1114, and one or more audio speakers 1116. The primary display area 1112 or the secondary display area 1114 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1110. The wagering game machine 1110 includes a touch screen(s) 1118 mounted over the primary or secondary areas, buttons 1120 on a button panel, bill validator 1122, information reader/writer(s) 1124, and player-accessible port(s) 1126 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts. In some embodiments, the wagering game machine 1110 includes an autostereoscopic 3D display.

Input devices, such as the touch screen 1118, buttons 1120, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

General

For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for presenting a shared virtual object in a community wagering game presented on a plurality of wagering game machines, the method comprising:

determining, by a movement tracking sensor, a head position of a first player of the community wagering game;

determining, by a location tracking device, a location of a first wagering game machine of the plurality of wagering game machines, wherein the first wagering game machine includes a value input device configured to receive monetary value for placement of wagers in the community wagering game;

determining, based on the head position of the first player and the location of the first wagering game machine, a viewable portion of the shared virtual object on which to present a first portion of a plurality of symbols that pertain to a first outcome for the community wagering game pertinent to the first player; and causing the first portion of the plurality of symbols of the shared virtual object to be presented on a first display device of the first wagering game machine, without causing at least one symbol from a second portion of the plurality of symbols to be presented on the first display device, wherein the second portion of the plurality of symbols pertain to a second outcome for the community wagering game associated with a second player, and wherein the second outcome is a different outcome from the first outcome.

2. The method of claim 1, wherein the community wagering game is a card game, and wherein the shared virtual object is a card of the card game.

3. The method of claim 1, wherein the determining the head position further comprises:

analyzing video content captured by a camera.

4. The method of claim 1 further comprising:

receiving player input indicating interaction with the shared virtual object on a display screen of the first display device; and determining, based in part on the interaction with the shared virtual object, a result for the community wagering game.

5. The method of claim 1, wherein the shared virtual object is a graphical representation of a physical object.

6. The method of claim 1, wherein the second portion of the plurality of symbols are concurrently presented on a second display device of a second wagering game machine for the second outcome without at least one symbol from the first portion of the plurality of symbols being presented via the second display device.

7. A non-transitory computer readable storage medium having instructions stored thereon, which when executed by at least one processor of a first wagering game machine and a second wagering game machine cause the at least one processor to perform operations comprising:

generating a shared virtual object as part of a community wagering game involving a first player and a second player;

determining, via one or more location tracking sensors, a first head position of the first player at the first wagering game machine residing at a first location, wherein the first wagering game machine includes a value input device configured to receive monetary value for placement of wagers in the community wagering game;

determining, a second head position of the second player at the second wagering game machine residing at a second location;

determining, based on the first head position and the second head position, a first viewing field for the first player and a second viewing field for the second player;

determining, based on the first viewing field and the first location, a first portion of the shared virtual object on which to present a first portion of a plurality of symbols that pertain to a first outcome for the community wagering game pertinent to the first player;

causing, as part of the community wagering game, presentation of the first portion of the plurality of symbols on the first portion of the shared virtual object by a first wagering game; and causing, as part of the community wagering game, presentation of a second portion of the plurality of symbols on a second portion of the shared virtual object by the second wagering game machine, wherein the second portion of the plurality of symbols pertain to a second outcome for the community wagering game associated with the second player, and wherein the second outcome is a different outcome from the first outcome.

8. The non-transitory computer readable storage medium of claim 7, wherein the first viewing field enables the first player to see information affecting a result of the community wagering game.

9. The non-transitory computer readable storage medium of claim 7, wherein the first viewing field is captured by a virtual camera directed at the shared virtual object.

10. The non-transitory computer readable storage medium of claim 7, said operations further comprising:

receiving, from the first player, input indicating selection of a game element appearing on the shared virtual object;

determining a result for the selection of the game element; and providing the result for presentation to the first player and the second player.

11. The non-transitory computer readable storage medium of claim 7, wherein the first viewing field and the second viewing field are limited based on rules of the community wagering game.

12. The non-transitory computer readable storage medium of claim 7, said operations further comprising:

causing the presentation of the first portion of the plurality of symbols on the first portion of the shared virtual object by the first wagering game, wherein at least one symbol from the second portion of the plurality of symbols is not presented on the first portion of the shared virtual object; and causing the presentation of the second portion of the plurality of symbols on the second portion of the shared virtual object by a second wagering game wherein at least one symbol from the first portion of the plurality of symbols is not presented on the second portion of the shared virtual object.

13. A method for presenting, via a gaming system, a shared virtual object as part of a community wagering game, the method comprising:

determining, via one or more location sensing devices of the gaming system, a location of a first wagering game machine associated with the community wagering game, wherein the first wagering game machine includes a value input device configured to receive monetary value for placement of wagers in the community wagering game;

determining, based on the location of the first wagering game machine, a first viewable portion of the shared virtual object on which to present a first portion of a plurality of symbols that pertain to a first outcome for the community wagering game pertinent to the first wagering game machine;

causing, as part of the community wagering game, presentation of the first portion of the plurality of symbols via the first viewable portion of the shared virtual object on a first display device of the first wagering game machine without causing at least one symbol from a second portion of the plurality of symbols to be presented on the first display device;

determining, based on a location of a second wagering game machine associated with the community wagering game, a second viewable portion of the shared virtual object on which to present a second portion of the plurality of symbols that pertain to a second outcome for the community wagering game pertinent to the second wagering game machine; and causing, as part of the community wagering game, presentation of the second portion of the plurality of symbols via the second viewable portion of the shared virtual object on a second display device of the second wagering game machine without causing at least one symbol from the first portion of the plurality of symbols to be presented on the second display device.

14. The method of claim 13, wherein the shared virtual object is a graphical representation of a physical object.

15. The method of claim 13, further comprising:

detecting player input indicating selection of game elements appearing on the shared virtual object.

16. The method of claim 13, wherein the community wagering game is a Texas Hold 'Em Poker game, and wherein the shared virtual object is a playing card used in the community wagering game.

17. The method of claim 13 further comprising:

determining a head position of a first player at the first wagering game machine based on images captured by a head tracking camera; and determining a third viewable portion of the shared virtual object based on the head position of the first player at the first wagering game machine.

18. An apparatus comprising:

a camera configured to capture video indicating head positions of a first player of a community wagering game;

a first electronic display device configured to present portions of a shared virtual object of the community wagering game;

a value input device configured to receive monetary value for placement of wagers in the community wagering game;

a processor; and a memory device connected to the processor, the memory device including instructions which when executed by the processor cause the processor to control operations to, process the video to determine the head positions of the first player of the community wagering game, determine, by a location tracking device, a location of the apparatus, determine, based on the head positions and the location of the apparatus, one of the portions of the shared virtual object on which to present a first portion of a plurality of symbols that pertain to a first outcome for the community wagering game pertinent to the first player, and present, on the first electronic display device, the first portion of the plurality of symbols via the one of the portions of the shared virtual object, wherein at least one symbol from a second portion of the plurality of symbols is not presented on the first electronic display device, wherein the second portion of the plurality of symbols are presented via a second electronic display device of a wagering game machine associated with a second player of the community wagering game, wherein the second portion of the plurality of symbols pertain to a second outcome for the community wagering game associated with a second player, and wherein the second outcome is a different outcome from the first outcome.

19. The apparatus of claim 18, wherein the shared virtual object represents a game element representing one of a final result for the community wagering game and an intermediate result for the community wagering game.

20. The apparatus of claim 18, wherein the community wagering game is a picking game, and wherein the shared virtual object includes game elements to be picked by the first player.

21. The apparatus of claim 18, wherein each of the head positions is associated with a different one of the portions of the shared virtual object.

22. The apparatus of claim 18, wherein the first electronic display device is a stereoscopic three dimensional device configured to present the portions of the shared virtual object in stereoscopic three dimensions.

* * * * *